US005098012A

United States Patent [19]

Will

[11] Patent Number: 5,098,012

[45] Date of Patent: Mar. 24, 1992

[54] PACKAGE

[75] Inventor: Peter M. Will, Bovenden, Fed. Rep. of Germany

[73] Assignee: Lever Brothers Company, Division of Conopco, Inc., New York, N.Y.

[21] Appl. No.: 30,029

[22] Filed: Mar. 24, 1987

[30] Foreign Application Priority Data

Mar. 27, 1986 [GB] United Kingdom ..... 8607781

[51] Int. Cl.[5] ..... B65B 11/58

[52] U.S. Cl. ..... 229/87.01; 206/548

[58] Field of Search ..... 229/87 R; 220/68, 73, 220/74, 400; 206/548, 492

[56] References Cited

U.S. PATENT DOCUMENTS

| | | | |
|---|---|---|---|
| 2,155,668 | 4/1939 | Little | 229/87 R |
| 2,624,989 | 1/1953 | White | 53/3 |
| 2,665,834 | 1/1954 | Anglada | 229/87 R |
| 2,973,893 | 3/1961 | Carlin et al. | 229/87 R |
| 3,159,274 | 12/1964 | Burt | 206/45.33 |
| 3,249,286 | 5/1966 | Palmer | 229/87 R |
| 3,260,359 | 7/1966 | Willhite | 229/87 R |
| 4,589,552 | 5/1986 | Chevalier | 229/87 R |
| 4,627,223 | 12/1986 | Janhonen | 229/87 R |

FOREIGN PATENT DOCUMENTS

| | | |
|---|---|---|
| 1879737 | of 0000 | Fed. Rep. of Germany . |
| 8302764 | of 0000 | PCT Int'l Appl. . |
| 876757 | of 0000 | United Kingdom . |
| 1021557 | of 0000 | United Kingdom . |
| 1073840 | of 0000 | United Kingdom . |

*Primary Examiner*—Willis Little

*Attorney, Agent, or Firm*—A. Kate Huffman

[57] ABSTRACT

A pack containing an article such as a bar of soap consists of an inner tubular liner within an outer wrapper. The material of the inner liner is folded over at opposite edges to form increased thickness margins at opposite ends of the pack. The outer wrapping may be of paper and has flap closures at opposite ends which are secured by adhesive. It can be arranged that the adhesive also secures the outer wrapping to the liner, preferably over faces of said folded over margins. By these measures, a more economical pack can be provided, employing a thinner grade of material for the inner liner, without sacrificing the degree of protection afforded to the article within the pack.

8 Claims, 1 Drawing Sheet

PACKAGE

FIELD OF THE INVENTION

This invention relates to packages for solid articles.

BACKGROUND OF THE INVENTION

Articles such as bars of soap which require some protection and brand identification but which do not justify expensive and elaborate packaging may be packed in a paper wrapper. As a support for the thin paper wrapper, to allow a clean neat fold of the ends of the wrapper in a controlled manner on an automatic wrapping line, and also to stabilise the bars when they are packed or stacked, there may be a thicker paper or card inner liner within the wrapper. The liner takes the form of a simple rectangular sheet approximately equal in length to the article and wrapped around it is an encasing tube. Such an inner liner also serves the purpose of simplifying the wrapping of articles with curved or otherwise non-planar faces, and with the convex surfaces often adopted in bars of soap the liner forms an air space around the ends of the bar, which provides added protection.

SUMMARY OF THE INVENTION

It is an object of the present invention to provide an economical form of packaging comprising an outer wrapper and inner liner. A pack in accordance with the invention, for a solid article, comprises, within an outer wrapper, an inner tubular liner in the form of a sheet having a pair of opposed parallel edges at opposite ends of its tubular form where the material of the sheet is folded over to form increased thickness margins at said edges of the sheet.

The known inner liners for bars of soap are made from paper or board having a wide range of weights depending upon a number of factors including the quality of the material and the contours of the bar. In principle the maximum width of the margin on an inner for a pack according to the invention is dictated by economic factors, but generally only a narrow folded margin is needed to give a substantial increase in stiffness at the edges of the sheet. As an example, if the inner liner used at present is of 170 gm paper, a folded-over margin of some 2 mm at the opposite ends of a 147 gm liner sheet of the same quality will give the edges the same or better stability, although less material is used. Normally, the width of the margin may be between 1 mm and 6 mm; widths significantly greater than 6 mm will usually not give any saving of material, and a width of between 2 mm and 4 mm will usually be preferred, but in particular cases some advantages may still be obtained with margins up to 10 mm wide. The invention does not preclude the possibility of multiple-fold margins, although in many instances these will not give any advantage that compensates for the increased production effort.

The invention also has the advantage that the formation of the folded margins in the liners can be achieved simply and very economically. In a preferred method of forming the liners, a continuous wed of liner material is passed through rolls which form creases or foldlines along opposite side edges of the web to define the margins, guide means fold said edges over to an acute angle with the web, and pressure means then press them down against the strip to complete the folded margins.

When, as is common, an outer wrapper has flapped closures which lie over the ends of the article at the edges of an inner liner and which are sealed by a hot-melt adhesive, it is found that the activated areas of the adhesive extend beyond the surfaces to be sealed together and where these areas come into contact with it there can be adhesion to the inner liner. This occurs by chance, i.e. inadvertently or because the heating apparatus is not correctly operated, and normally does not have any appreciable effect. If, as can be arranged, the margin folds of a liner used in the present invention provide a larger contact face with these activated areas than a plain sheet liner, however, a stronger bond can be produced and the stiffness of the completed package is thereby further increased. This improvement relies also on the increased local stiffness at the folded over margins which makes them more resistant to buckling or vibrating through the pressures applied during the sealing process. It will be understood that a similar result can be obtained, although perhaps less conveniently, not only with heat-sealing agents but also with other adhesives such as glue.

By way of example, the invention will be described in more detail with reference to the accompanying drawings.

DESCRIPTION OF THE PREFERRED EMBODIMENTS

Figure 1:
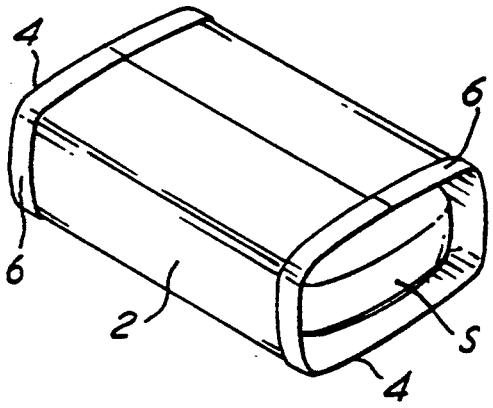
FIG. 1 shows the liner for a package according to the invention and containing a bar of soap.
Figure 2:
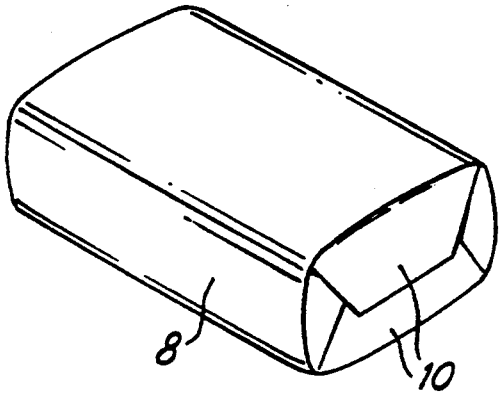
FIG. 2 shows the completed package.

In FIG. 1, an oblong bar of soap S with convex faces has a paper sheet wrapped around it to form a tubular liner 2, open at the ends 4. At these ends, the material of the liner has been folded over to provide a double-thickness margin 6 some 2.5 mm wide. The liner is made from 147 g paper so that the material thickness at the folded over edges is significantly greater than in a conventional plain liner using 170 g material.

In the packaging line, the liner can be wrapped around the soap in the same manner as a conventional plain liner, i.e. being placed together with a conventional outer wrapper 8 of thinner, preferably moisture-resistant, paper. After that step the combined wrapper and liner is wrapped closely around the soap and the usual flap closures 10 are formed at opposite ends of the wrapper supported by stiffened end margins. The folded over flaps of the closures may be secured together by adhesive, e.g. by a hot-melt adhesive coating the inner face of the paper wrapper. Because the folded over end margins of the liner present a significantly larger end surface than the cut edges of a conventional plain liner, it can be arranged that the hot-melt adhesive also attaches the outer wrapping to the liner in the regions of theses end edges so that together they form a laminated structure increasing the local stiffness.

As a "hot-melt adhesive" it is possible to use heat-activated sealing material such as coatings with PE, ionomers, EVA, PP, their mixtures or copolymers, with each other and with vinyl-acetate, acrylic-acid and the whole range of thermoplastic materials which are tacky when hot, and solid when cold, a process which is reversible. Other suitable materials are wax, blends, resins, heat-seal-varnishes, rosins, etc. The coating may be continuous or a pattern coating. If the complete inside face of the wrapper is coated the sealing material may serve as a mositure and vapour barrier.

To increase the area of adhesion between the liner and the wrapper, the folded over margins may be disposed on the outer periphery of the liner so that their outer faces stand slighty proud of the adjoining main extent of the liner. Sufficient local pressure can then be appled to the margin outer faces to ensure the adhesion of these faces to the wrapper, in addition to the adhesion between the axial end edges of the liner and the wrapper substantially in the planes of the end wrapper flap seals.

Figure 3:
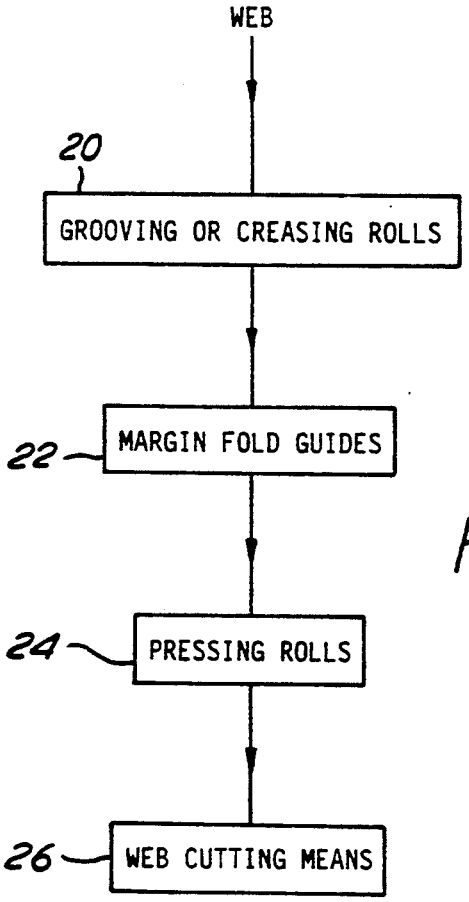
FIG. 3 is a schematic illustration of the means for forming the folded over edges of the liner of FIG. 1.

FIG. 3 illustrates schematically the formation of the liner from a continuous web of paper. The apparatus for each of the illustrated stages of manufacture can be of conventional form, as will be understood by those skilled in the art, and more detailed illustration is therefore unnecessary.

The web is drawn through a pair of creasing rolls 20 where creases or fold lines are formed defining the extent of the margins in the side edges of the web, and possibly the rolls also produce an initial bending of the margins out of the plane of the web. Folding means 22, e.g. stationary guides fold over the margins to an acute angle with the main area of the web as the web travels between the creasing rolls and a pair of pressing rolls 24 which press the folded-over portions flat against the main area of the web.

Finally, a known cutting means 26 severs the required lengths from the web to form the liners which are wrapped around the product. For the best results, care is taken to ensure that the liner walls are straight along their length and not bent inwards or outwards, so that they have the maximum resistance to axial compression forces. The folded-over margins may lie on the outside of the liner, if it is required to achieve an optimum bonding with the outer wrapper as described above, and liners so arranged may be easier to handle in an existing packing line. If it is more important to provide a pack with a smooth outer surface, however, the liners may be wrapped around the product with the folded-over margins at the inside.

The grooving or creasing rolls may form a simgle crease line for each margin or multiple crease lines, e.g. a pair of crease lines that define a strip of a defined width that will be disposed substantially perpendicular to the main area of the liner and so form an adhesion face generally parallel to the outer wrapper end flaps.

I claim:

1. A pack for a solid article comprising:

(a) a sheet of liner material wrapped around the article into a tubular form having two parallel end edges defining two opposed end openings, a portion of each end edge being folded back over the liner material at least once resulting in multiple thickness of liner material at each end edge and surrounding each end opening, the tubular form of liner material so folded having a length from one end opening to the other substantially equal to that of the solid article; and (b) an outer wrapper covering the tubular form of sheet material and closing the open tubular ends thereof;

the sheet of liner material and outer wrapper forming a closed protective enclosure for the article.

2. A pack according to claim 1 wherein each said margin is less than 10 mm wide.

3. A pack according to claim 2 wherein each said margin is not substantially more than 6 mm wide.

4. A pack according to claim 3 wherein said margins are each between 2 mm and 4 mm wide.

5. A pack according to claim 1 wherein said folded over portions are disposed on the outer periphery of the tubular liner facing away from said solid article.

6. A pack according to claim 1 wherein adhesive means attach the outer wrapper to the liner in the regions of said increased thickness margins.

7. A pack according to claim 1 wherein said folded over portions are disposed on the outer periphery of the tubular liner facing away from said solid article, whereby there are regions of contact between the folded over portions and the outer wrapper, and adhesive means applied to the outer wrapper attach said folded over portions to said wrapper.

8. A pack according to claim 7 wherein the outer wrapper has respective end closures adjacent said opposite ends of the inner liner and an adhesive coating is provided on an inner face of the wrapper for sealing said end closures, said adhesive coating extending into contact with said edges of the liner and adhering said margins of the liner to the wrapper.

* * * * *